US010800625B2

(12) United States Patent
Bhide et al.

(10) Patent No.: US 10,800,625 B2
(45) Date of Patent: Oct. 13, 2020

(54) MEDIA SKEW CORRECTION

(71) Applicant: Hewlett-Packard Development Company, L.P., Houston, TX (US)

(72) Inventors: Saurabh Bhide, Vancouver, WA (US); Rafael Gonzalez, Vancouver, WA (US); Luke P Sosnowski, Camas, WA (US); Joseph Emery, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/761,496

(22) PCT Filed: Dec. 8, 2015

(86) PCT No.: PCT/US2015/064505

§ 371 (c)(1),
(2) Date: Mar. 20, 2018

(87) PCT Pub. No.: WO2017/099729

PCT Pub. Date: Jun. 15, 2017

(65) Prior Publication Data

US 2018/0273325 A1 Sep. 27, 2018

(51) Int. Cl.

| | |
|---|---|
| ***B65H 9/00*** | (2006.01) |
| ***B65H 7/06*** | (2006.01) |
| ***B65H 7/08*** | (2006.01) |

(52) U.S. Cl.

CPC ..... *B65H 9/002* (2013.01); *B65H 7/06* (2013.01); *B65H 7/08* (2013.01); *B65H 9/00* (2013.01); *B65H 2220/02* (2013.01); *B65H 2511/242* (2013.01); *B65H 2557/61* (2013.01)

(58) Field of Classification Search

CPC ... B65H 7/00; B65H 7/02; B65H 7/06; B65H 7/08; B65H 7/20; B65H 9/00; B65H 9/002; B65H 2511/242

See application file for complete search history.

(56) References Cited

U.S. PATENT DOCUMENTS

| | | | | |
|---|---|---|---|---|
| 5,120,977 | A | 6/1992 | Dragon et al. | |
| 5,918,877 | A * | 7/1999 | Takei | B65H 7/06 271/261 |
| 6,281,918 | B1 | 8/2001 | Burdick et al. | |
| 7,806,403 | B2 | 10/2010 | Canon | |

(Continued)

FOREIGN PATENT DOCUMENTS

| | | |
|---|---|---|
| JP | 201230928 | 2/2012 |

OTHER PUBLICATIONS

Manual Machine ~ HP Designjet L25500 Service Manual ~ Date Unknown ~ 13 Pages.

*Primary Examiner* — Prasad V Gokhale
(74) *Attorney, Agent, or Firm* — HP Inc. Patent Department

(57) ABSTRACT

Media skew correction is performed by determining a leading edge skew value for the media and selecting a respective media model from a memory for a media type, each media model including a paired slope and an intercept. Based on the paired slope and intercept for the respective media model, differential velocity of a pair of aligned media feed rollers in a media feed mechanism is adjusted to correct a trailing edge skew for the media to within a desired operational window.

12 Claims, 6 Drawing Sheets

(56) References Cited

U.S. PATENT DOCUMENTS

| | | | | |
|---|---|---|---|---|
| 8,308,160 | B2 | 11/2012 | Canon | |
| 8,342,517 | B2 | 1/2013 | Kinoshita et al. | |
| 8,437,682 | B2 | 5/2013 | Moriya | |
| 8,827,406 | B1 | 9/2014 | de Jong et al. | |
| 2004/0246285 | A1 | 12/2004 | Endo | |
| 2004/0247355 | A1 | 12/2004 | Eguchi | |
| 2005/0019076 | A1 | 1/2005 | Puckett, Sr. et al. | |
| 2009/0309298 | A1* | 12/2009 | Herrmann | B65H 7/06 271/227 |
| 2010/0172684 | A1* | 7/2010 | Nakagawa | B65H 3/0661 400/579 |
| 2012/0025457 | A1 | 2/2012 | Inoue | |
| 2012/0267847 | A1* | 10/2012 | Ootsuka | B65H 7/10 271/234 |
| 2013/0099046 | A1 | 4/2013 | Canon | |
| 2015/0197106 | A1 | 7/2015 | Mackey et al. | |

* cited by examiner

MEDIA SKEW CORRECTION

BACKGROUND

While the dream of a "paperless" office has been around for years, various forms of tangible cut sheet media continue to be used in significant quantities due to their versatile and permanent nature, such as paper, Mylar, plastic, photo paper, and the like. Some example cut sheet media devices include but are not limited to, printers, scanners, faxes, and copiers. However, hard copy media quality expectations continue to increase in this age of digital media. At the same time, prices for cut sheet media creation devices are being driven downward. This price decline is due to digital media's inherent ability to be re-used despite its transient nature, thus reducing some demand for cut sheet media output. As a result, both business and consumers are expecting that their cut sheet media devices be affordable and produce results with the same high quality as their digital media devices.

BRIEF DESCRIPTION OF THE DRAWINGS

The disclosure is better understood with reference to the following drawings. The elements of the drawings are not necessarily to scale relative to each other. Rather, emphasis has instead been placed upon clearly illustrating the claimed subject matter. Furthermore, like reference numerals designate corresponding similar parts through the several views.

DETAILED DESCRIPTION

This disclosure describes a new technique for correcting skew in media that is very flexible for varying media types and can be implemented with little component cost. 'Skew' is an oblique angle or a slant of the media relative to a centerline of the media or to a line representing a desired target for the media leading edge for further processing of the media. Media skew is generally desired to be corrected, reduced, or eliminated to achieve the highest quality results. The skew correction technique discussed herein greatly improves a media handling device's versatility to correct such skew for multiple forms of media, media size, and media orientation by the use of media models that are used to correct skew for one or more media types. Media alignment systems are used in cut sheet media manipulation devices to ensure proper alignment of the media before it is processed such as with printers, scanners, copiers, coaters, and the like. With the skew correction technique disclosed herein, the speed of media handling for the media manipulation devices may be greatly improved. There may also be an acoustical reduction in noise as any paper feed servo motors can be operated continuously without the constant starting and stopping of conventional nip and buckle type de-skewers typically found in conventional media manipulation devices.

In some examples, having a continuous feed skew adjustment allows for a significant increase in pages per minute of media processing. Further, if a media alignment system is found to be out of specification or the operating window for its de-skewing operation, a media characterization may be performed in order to restore the media alignment system back to acceptable operational levels for particular media that does not get properly de-skewed. For instance, a printer user interface may be presented to a user to linearize a relationship between induced skew and the differential velocity of separate media drive shafts as will be described. These and other advantages will be described further in the following detailed discussion of the claimed subject matter.

Figure 1:
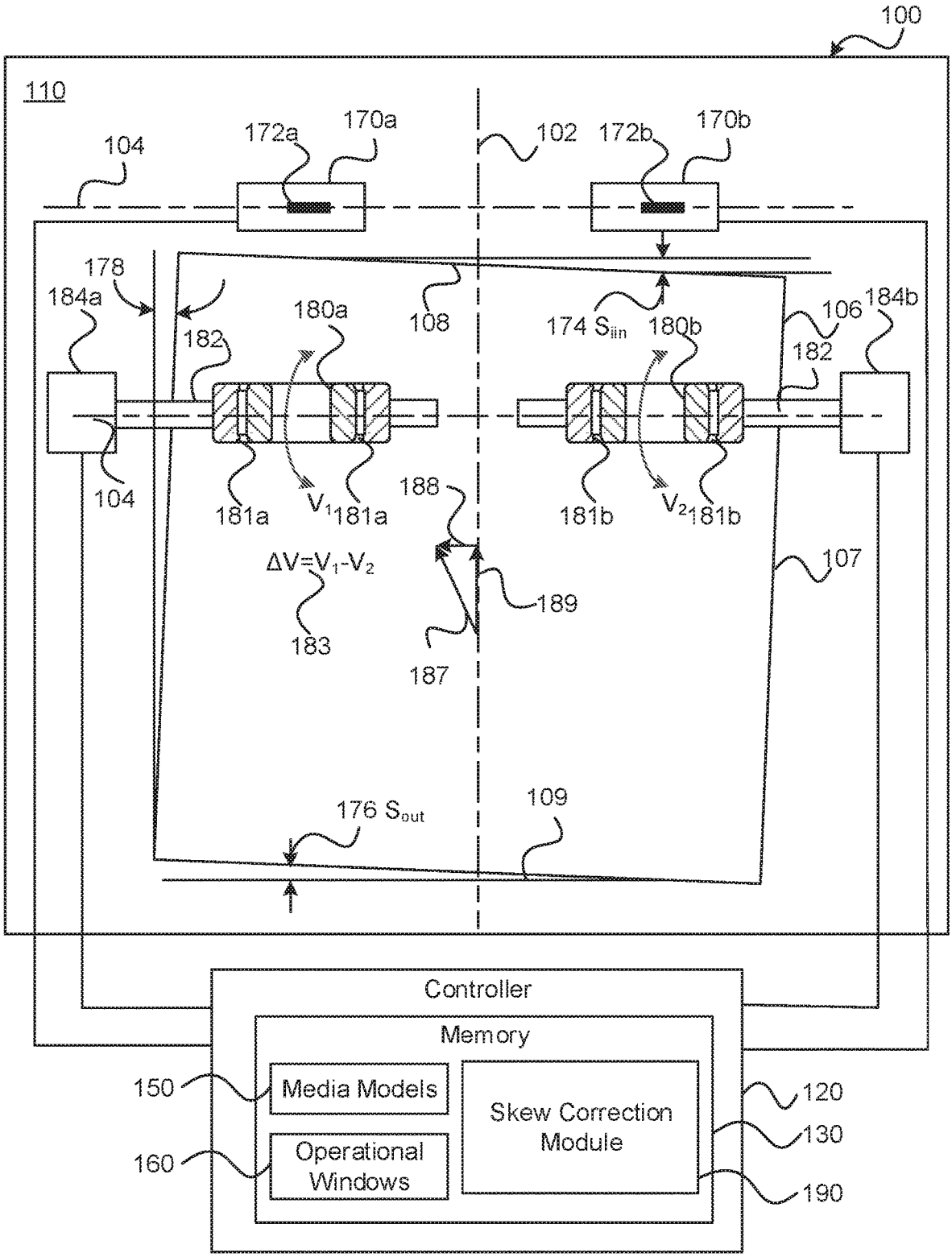
FIG. 1 is a simplified schematic diagram of an example media alignment system.

FIG. 1 is a simplified schematic diagram of an example media alignment system 100. Media alignment system 100 may be used in such media manipulation devices such as fluid jet printers and copiers, toner based printers and copiers, scanners, sheet coaters, plotters, binders, collators, sorters, fax machines, signage printers, and other like devices which typically handle cut sheets of media. In this example, two rollers 180*a* and 180*b* are coupled to servo motor feeds 184*a* and 184*b*, respectively, and may be separated (or alternatively connected with a slip-shaft) as half-shafts. These half-shafts allow for the independent speed or velocity ($v_1$), ($v_2$) of rollers 180*a*, 180*b* by the respective servo motor feeds 184*a*, 184*b*. These dual independent servo motor feeds 184*a*, 184*b* and their respective rollers 180*a* and 180*b* may also be referred to as differential velocity drives. Each roller 180*a*, 180*b* may have one or more tires 181*a*, 181*b* (often times referred to also as COTS) to grip the media. The servo motor feeds 184*a*, 184*b* are coupled to a controller 120. The rollers 180*a* and 180*b* may be oriented along a first direction 104 that is typically substantially orthogonal to a second direction 102 in which a media 106 advances or retreats along a media guide mechanism 110. In some examples, there may be a slight angular offset between the first direction 104 and the second direction 102 and this is may contribute to a 'native skew' of the media alignment device 100.

The controller 120 may drive the servo motor feeds 180*a* and 180*b* in just a single forward direction or both forward and reverse directions independently depending on the implementation. The servo motor feeds 180*a* and 180*b* may also include encoders to determine the position of the respective servo motor. The differential velocity 'Δv' 183 (defined as v1-v2) causes a media 106 to typically rotate clockwise or counterclockwise depending on the sign of Δv, while the average velocity of v1 and v2 determine the forward and/or backward speed in the direction of second direction 102. Accordingly, the media guide mechanism 110 includes a first roller 180*a* and a second roller 180*b* that are aligned in a first direction 104 that is substantially orthogonal to the second direction 102 for advancement of the media 106.

A memory 130 is coupled to the controller 120 and may contain a set of one or more media models 150. The actual design of the media models 150 are described further below but have been architected to account for a number of variables of the media type 107 and its interaction with a media alignment system 100.

For instance, the media 106 can be one of several media types 107. The media type 107 may include such factors as weight, material, thickness, size, orientation, stiffness, texture, color, transparency, opaqueness, to just name some examples. The media type 107 can also be influenced by such factors as humidity, media transit speed, variations in media alignment system construction, and other characterization parameters such as the number of tires 181 on the feed rollers 180*a*, 180*b* that are in contact with the media 106, and a media transit distance over which the differential velocity 183 is applied.

A pair of media sensors 170*a*, 170*b* have media edge detectors 172*a*, 172*b* respectively, such as switches, infrared, visible light, or ultraviolet LED diodes and semiconductor sensors or other mechanical or optical input devices, to detect a leading edge skew value 108 and a trailing edge skew value 109 of media 106. In some examples, the media sensors 170*a*, 170*b* may be REDI sensors. The media sensors 170*a*, 170*b* are coupled to the controller 120 and are substantially aligned in the first direction 104. In one example, each of the servo motor feed encoder positions may be read when each media sensor 170*a*, 170*b* is triggered. The difference in the same encoder position encoder values may then be used as the skew of the media 106. Alternatively in another example, when media 106 is skewed, there is a difference in time from when one of the media edge detectors 172*a*, 172*b* is triggered before the other media edge detector 172*a*, 172*b* is triggered. This time difference can be used with the media advancement speed or average velocity to derive the leading edge skew value 174 and the trailing edge skew value 176 as each respective leading edge 108 or trailing edge 109 passes beneath the pair of media edge detectors 172*a*, 172*b*.

In the example using the position encoder values, two snapshots of the servo motor feed encoder positions may be captured and stored in registers within the controller 120 as the leading 108/trailing 109 edge of the media 106 trips/untrips each of the pair of media sensor's 170*a*, 170*b* media edge detectors 172*a*, 172*b*. Media sensor 170*a* may be referred to as a front sensor and media sensor 170*b* may be referred to as a rear sensor. A de-skew encoder count snapshot for the front sensor may be labeled as $EC_{front}$ and a de-skew encoder count snapshot for the rear sensor may be labeled as $EC_{rear}$. The leading edge skew value 174 of the leading edge 108 of media 106, $S_{in}$, may then be determined by the difference in the encoder count snapshots. The direction of the leading edge skew value 174 is determined by the sign of $S_{in}$ where:

$$S_{in} = EC_{front} - EC_{rear}$$

The trailing edge skew value 176, $S_{out}$, is determined in the same manner as $S_{in}$ when the trailing edge 109 of media 106 passes beneath the media edge sensors 172*a*, 172*b*, where:

$$S_{out} = EC_{front} - EC_{rear}$$

$S_{out}$ may be used for verification of skew correction effectiveness and in deciding whether to perform a characterization of the media alignment system 100. $S_{in}$ and $S_{out}$ may be paired and stored as arrays of pairs for successive sheets of media 106 that are feed in media alignment system 100. The paired arrays of $S_{in}$ and $S_{out}$ may be separated and maintained for a particular media size category or for a particular media type 107. For instance, in some example systems, there may be multiple media types 107 processed and a historical array of paired $S_{in}$ and $S_{out}$ values is maintained for each of the media types 107. The paired arrays may be stored in a buffer 140 in memory 130. The buffer 140 may be implemented as one or more circular buffers to store a predetermined number of last historical paired values.

Once both media edge sensors 172*a*, 172*b* have been triggered, a skew correction module 190 is executed by the controller 120 to adjust the velocities '$v_1$, $v_2$' of the first and second rollers 180*a*, 180*b* to create a differential velocity 183 '±Δv' based on a respective media model 150 for the media type 107 and the amount of leading edge skew 174 detected for the media 106. The differential velocity 183 '±Δv' is operated for a time period sufficient over a media travel distance 'd' 220 (FIG. 2) to reorient or de-skew the media 106 such that the trailing edge skew 176 is detected to be corrected within a desired operating window 160 for the media type 107 and the operating mode (speed, quality, resolution, etc.) of a particular media guide mechanism 110.

The skew correction module 190 may be very time sensitive in order to correct the skew within a desired distance 'd' 220 and thus may be executed as a high priority process in controller 120. When called, the skew correction module 190 modifies the servo motor feeds 184*a*, 184*b* relative speeds '$v_1$, $v_2$' by a differential velocity 183, '$\pm\Delta_v$'. The trigger of the two media edge sensors 172*a*, 172*b* may be continuously monitored using a servo motor interrupt level in the controller 120 during the timeframe that a page is expected to pass by the media edge sensors. As soon as the de-skew distance 'd' 220 is reached, the two servo motor speeds are then modified back to their original average speed 'v' of media 106 travel.

The controller 120 may include a tangible, non-transitory computer readable medium (CRM) 804 (FIG. 8) such as memory 130. Memory 130 may contain a set of one or more media models 150 and a set of one or more various desired operational windows 160 for the various media types and operating modes of the media guide mechanism 110. The memory 130 may also contain one or more software or firmware modules of computer executable code or instructions that when executed by the controller 120 (or one or more processors within the controller 120) cause the controller 120 to implement and execute the skew correction module 190. Controller 120 may include one or more processors integrated into a single devices or distributed across devices.

This technique for skew correction uses the two pairs of rollers 180*a*, 180*b* to cause the media to both advance by a transit force 189 in the second direction 102 based on an average velocity 'v' of the rollers 180*a*, 180*b*. By introducing a differential velocity between the two rollers 180*a*, 180*b* a shear force 188 orthogonal to the media advancement force causes the media 106 to rotate and de-skew during the same time that media 106 is advanced. The combination of the two forces 188, 189 creates a net shear force vector 187 that is applied to the media 106 for a set period of time that is calculated based on the media model and media speed to substantially de-skew the media 106 so that when the trailing edge 109 of the media 106 reaches the dual media edge sensors 172*a*, 172*b*, the media 106 is corrected or de-skewed to within an acceptable operational window 160.

Figure 2:
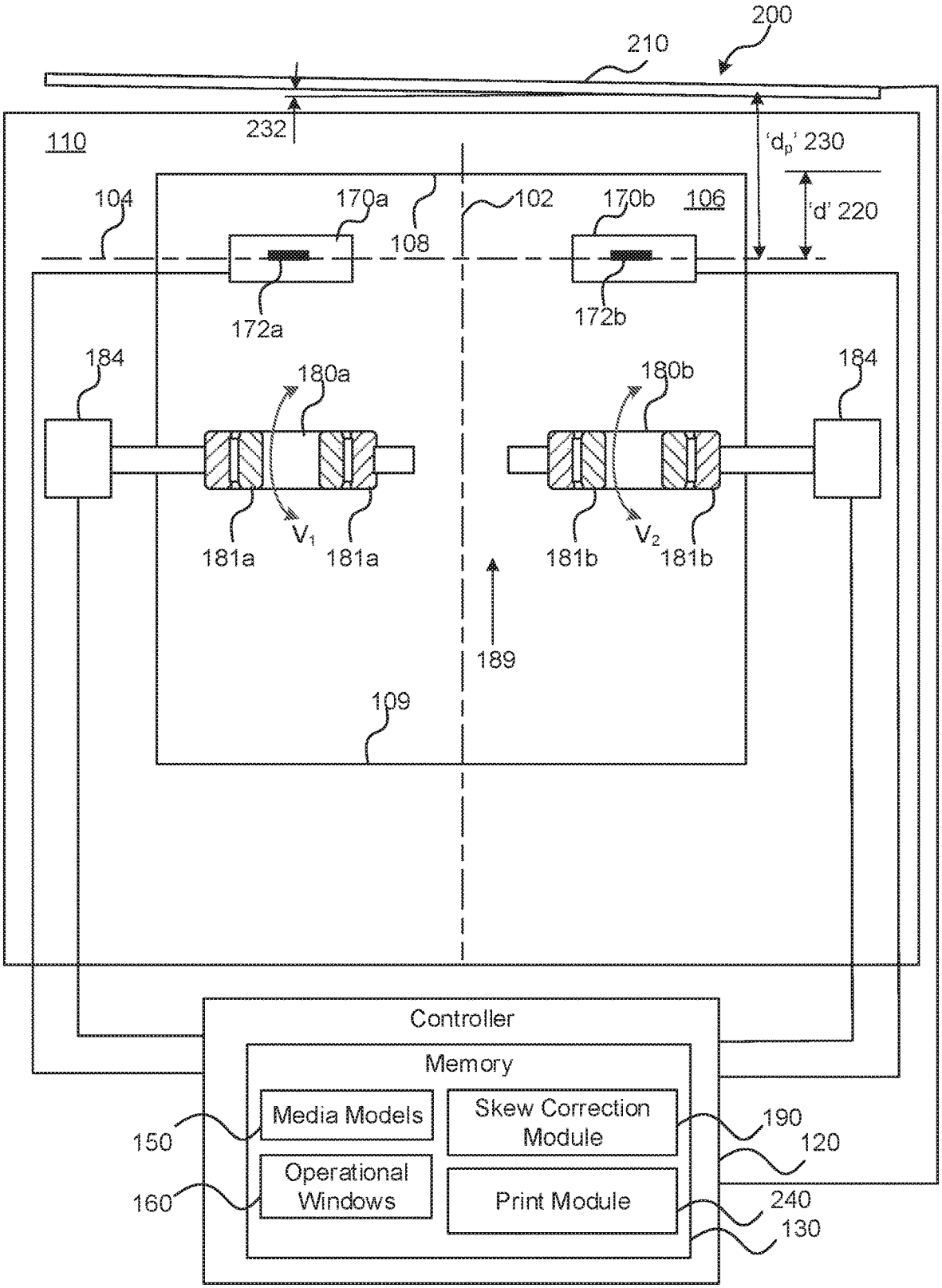
FIG. 2 is an example media guide mechanism that includes a printhead.

FIG. 2 is an example printer media alignment system 200 that includes a target objective, a print bar printhead 210 aligned and extending substantially along the first dimension 104 and a print module 240 to allow for printing on the media 106. In other examples, rather than a print bar, the printhead 210 may scan across a line extending substantially along the first dimension. In other examples, other target objectives such as a scan bar may be used in place of print bar printhead 210, as for a scanner or fax device. The printhead 210 while substantially extending along the first dimension 104 may have an angular offset 232 from a line extending between the pair of media edge sensors 172*a*, 172*b*, and thus leading edge 108 of the shown de-skewed media 106. The media 106 leading edge 108 should be aligned with the printhead 210 for highest quality and thus the media models 150 may adjust for this angular offset 232. This angular offset 232 may also be incorporated into the 'native skew' of the media alignment mechanism 110. The media 106 is shown as having been de-skewed after the leading edge has traveled a distance 'd' 220 from the pair of media edge detectors 172*a*, 172*b*. The distance 'd' 220 may be less than the distance '$d_p$' 230 to the printhead 210 to ensure media alignment with respect to the target printhead before printing. However, in some examples, such as with a blank top margin of the media, the distance "d' 220 could be larger than the distance '$d_p$' 230 to distribute the de-skew shear force 188 over a longer distance to put less stress on the media 106.

The distance 'd' may be calculated based on one or more factors, such as media speed, rotation per encoder sample, the time available to perform the media alignment, the amount of skew that needs to be corrected, and the media type and its ability to handle the shear forces involved in the de-skew process. Further, based on a particular hardware architecture and implementation, there may be physical limits on how much skew can be corrected based on lengths of specific media 106. Any attempt to correct a skew larger than such a limit may require multiple passes of the media through the de-skew process or alerting a user to realign the media such as is done with paper jams. For instance, the media may be placed in a media tray incorrectly such that the media tray pick mechanism is causing multiple sheets of media to be skewed more than can be corrected. Having the user check the media tray and position the media correctly may limit the amount of possible skew to within what may be corrected.

Figure 3:
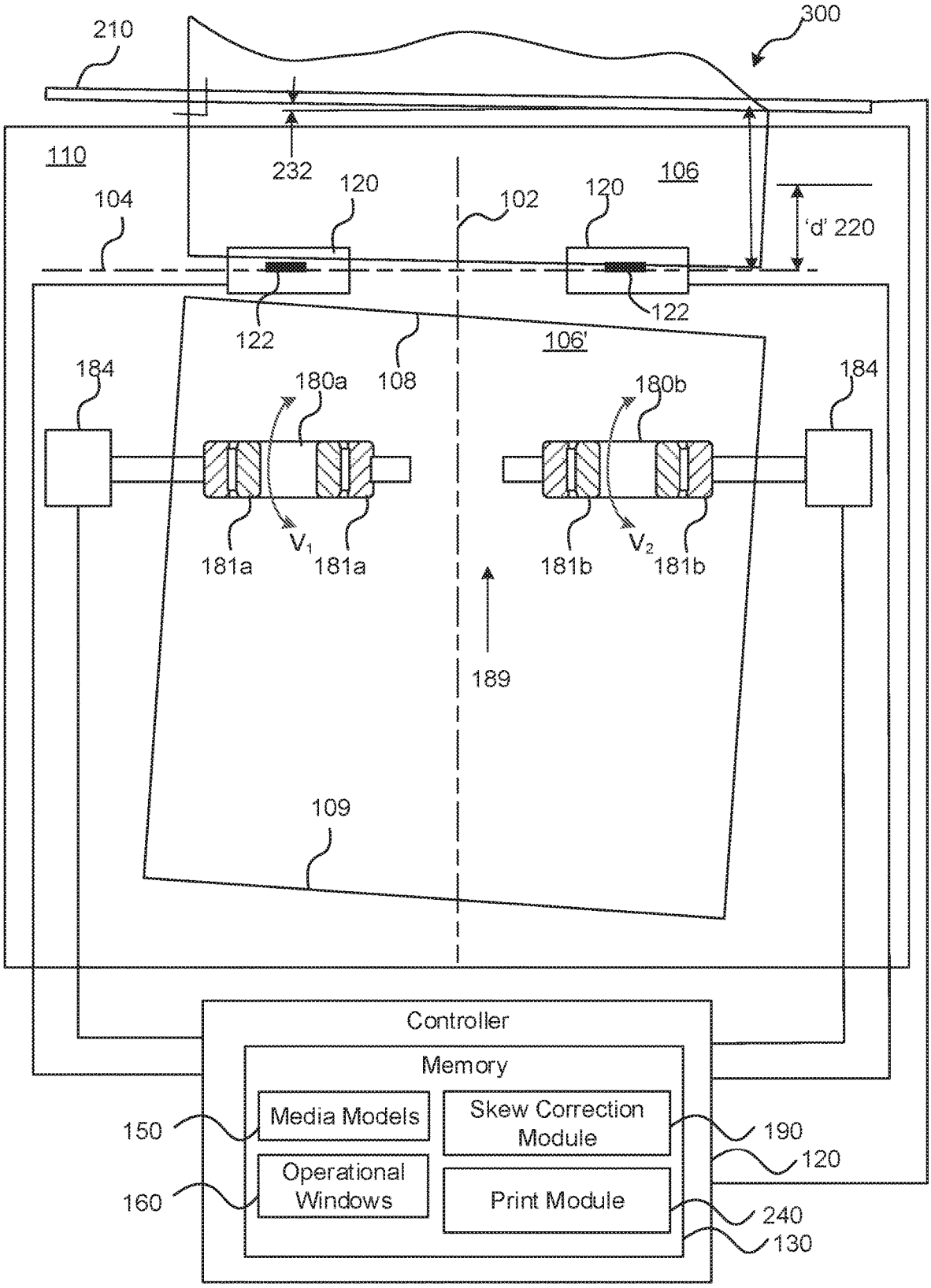
FIG. 3 is a further example of the mechanism of FIG. 2.

FIG. 3 is a further example of the printer media guide mechanism of FIG. 2 illustrating the advancement of media 106 such that its trailing edge 109 is detectable by the pair of media edge sensors 122*a*, 122*b*. In this example, the media 106 is shown slightly skewed with respect to the axis of first dimension 104 to highlight that the angular offset 232 of the printhead 210 has been corrected. The pair of media edge sensors 122*a*, 122*b* can be used to measure the skew of the trailing edge 109 to confirm proper alignment with the printhead 210 and/or used to keep statistics of printer performance for determining if a characterization or service maintenance should be performed. A second media 106' is shown as skewed and being advanced to the media edge sensors 122 by rollers 180*a*, 180*b* to begin the de-skew technique for a second media 106'.

In some examples, there may be more than one set of differential drives. For instance, there may be separate media paths each with a set of differential drives. In other examples, the multiple differential drives may be in series in a media path to allow for skew correction over a longer distance and/or to lessen the amount of shear force on the media at each set of the differential drives to reduce the risk of media tear or deformation. In another example, such as with an all-in-one device, there may be a set of differential drives for a printer function and another set of differential drives for a scanner function. In some instances, two or more sets of differential drives may be mechanically coupled but used for different purposes.

Figure 4:
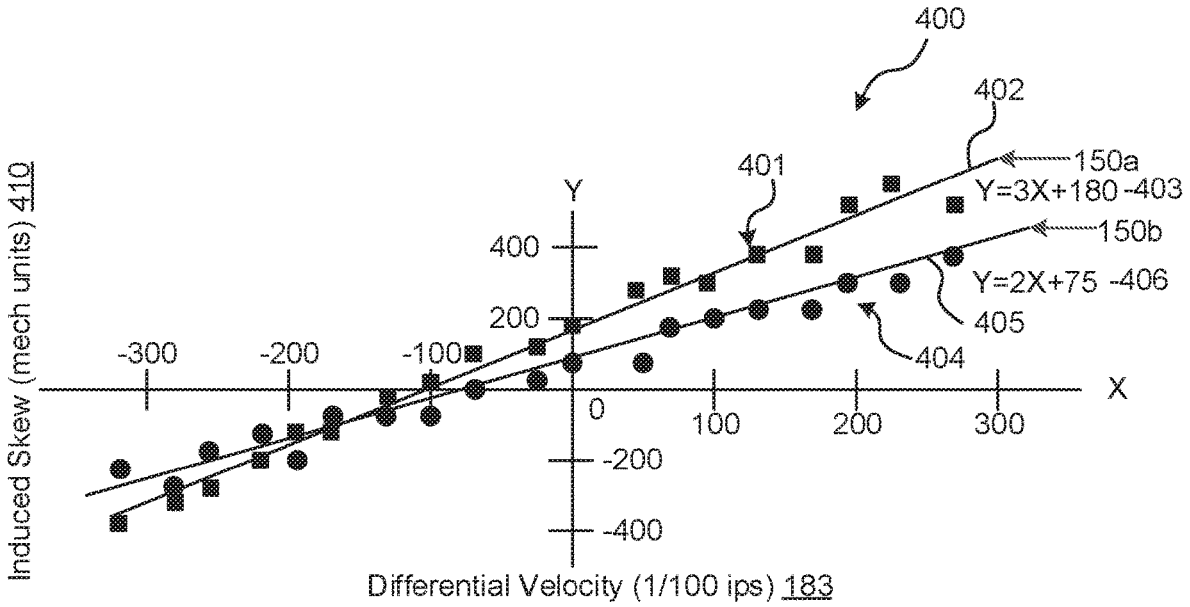
FIG. 4 is a chart illustrating example media responses of differential velocity versus induced skew data.

FIG. 4 is a chart 400 illustrating media responses of differential velocity 183 '±Δv' versus the induced skew 410 for a couple example media types 107. Since the media alignment system 100 uses two sets of rollers 180*a*, 180*b* to affect media alignment, the media 106 does not undergo a pure rotation but rather is subjected to a shear force 188 (FIG. 1) in the plane of the media. This shear force is difficult to model mathematically for all media types and media marking conditions. Accordingly, it is the insight of the inventors that by choosing to characterize the response of media 106 to various differential velocities 183 by means of empirical testing this media response characterization allows for the incorporation of multiple factors that affect skew. For instance, the "induced skew" 410, the difference between the leading edge skew 174 and the trailing edge skew 176 for a single media 106, can be measured and plotted against a set of applied "differential velocity" 183 for various media types 107.

In FIG. 4, the X axis represents the applied differential velocity 183 in units of 1/100 inches per sec (ips). Positive values indicate a first roller 180*a* having a greater speed than a second roller 180*b*, and negative values indicate the first roller 180*a* having a slower speed than the second roller 180*b*. The Y axis represents the media response in terms of measured induced skew 410 in units of mechanical units (mech units of the encoder) wherein the positive values measure skew in one rotation and negative values measure skew in an opposite rotation.

The square markers 401 represent a first example media response characterization population of a first media model 150*a* to determine the induced skew 410 with respect to various differential velocities 183. The test can be performed with a single sheet of media 106 run several times through the media alignment system 100, 200 with varying differential velocities 183 for each pass, or it can be performed running several different sheets of the media 106, say from a media tray, each at a different differential velocity 183 setting and the induced skew 410 derived from the leading 108 and trailing edges 107 skews measurements. The circle markers 404 represent a second example media response characterization population of a second media model 150*b* and is created similarly as for the first media model 150*a*. Each media model's characterization population is then linearized using linear regression to create a first response curve 402 for the first media model 150*a* and a second response curve 405 for the second medial model 150*b*. Each of the response curves 402, 405 has a slope 'm' and an intercept 'b' for the respective media model 150*a*, 150*b*. For instance, first media model 150*a* has a response curve 402 that is represented by a first equation 403, Y=3X+180, where "3" is the slope 'm' and "180" is the intercept 'b'. Second media model 150*b* has a response curve 405 that is represented by a second equation 406, Y=2X+75, where "2" is the slope 'm' and "75" is the intercept 'b'.

Let $S_{in}$ be the initial leading edge skew value 174 of a media 106. Correcting for $S_{in}$ is simply inducing a skew of $-1*S_{in}$. To apply a +Δv change to the first roller 180*a* and a −Δv change to the second roller 180*b* for a specific distance 'd' 220 of media travel, the 'differential velocity' 183 (in encoder mech. units) to apply for a given media model's slope m and intercept b is:

$$\Delta_v = \left(\frac{-1 * S_{in} - b}{m}\right)/2$$

Empirical testing has found, however, that a particular media model's 'm' and 'b' may be sensitive to several system aspects. For instance, the specific hardware configuration such as the number and placement of the tires 181*a*, 181*b* on the rollers 180*a*, 180*b* performing the skew correction, the media type 107, the size of the media, the media alignment mechanism 110 mode's average speed 'v', and the media travel distance 'd' 220 over which the 'differential velocities' 183 are applied. Empirical testing has shown that the constant 'b' is very sensitive to mechanical variations in hardware, unlike the constant 'm' which is not very sensitive. A lookup table for the constants 'b' and 'm' for different media models 150 or in some examples, just indexed by media lengths, may be stored in non-volatile memory (NVM) of the controller 120 in the media models 150 portion of memory.

The media model 150 for particular media 106 may be sensitive to the number of tires 181*a*, 181*b* on each half-shaft of the medial alignment system 100, 200 as well as their placement relative to the center of the media 106. Also, even when the hardware configuration of the media alignment system 100, 200 is constant, the media model 150 may be different for different media types 107 and therefore, a hardware configuration that has minimal changes between different media types 107 may allow for having a particular media model 150 represent multiple media types 107. For instance, in one example, having three equally spaced tires per roller on the half-shafts may reduce the variation of constants 'm' and 'b' for multiple media types 107 allowing for a single media model 150, optimized around an expected high use media 106 for the particular media alignment system 100, 200. That is, allowing the high use media model 150 to correct for various media types 107 of the same size may yield results that satisfy overall system operational requirements. However, in some instances where excellent image quality is desired, using a specific media model 150 for a specific media type 107 may yield the best results.

The media size determines how many of the roller tires 181*a*, 181*b* are in contact with the media 106 as well as how many rollers 180*a*, 180*b* are in contact with the media 106 during the "differential velocity" phase of skew correction. Media orientation (i.e. portrait vs landscape) may essentially change the media size (width and length) presented to the skew correction hardware. Width is defined to be across the media in the first direction 104 and length is defined to be along the media flow in the second direction 102. Accordingly, the media models 150 may be indexed by size and orientations, such as A-landscape, A-portrait, 4×6"-portrait, 4×6"-landscape, and 11×17"-portrait, as just some examples, and the respective corresponding constants 'm' and 'b' may be stored in a firmware lookup table in memory 130 accessible by the controller 120. To pick a particular media model 150 during operation, various combinations of paper-path media edge sensors, length sensors, paper information from print drivers, etc. allow for determination and selection of the correct media model 150 to get the correct correction constants 'm' and 'b'.

For instance, when a media tray is reloaded in the media alignment system 100, 200, one can assume that the media length equals the reading of the media tray length sensor and verify that it matches the specified media for the job via an operating system driver, such as a print driver. Alternatively, or in conjunction, the media length can be measured using paper-path edge sensors for the first sheet. Based off of the media type 107 and the determined or measured media length, the appropriate constants 'm' and 'b' in the media models 150 may be retrieved from lookup tables in memory 120. Successive pages from the same tray may then use the measured length of the media until the tray is opened.

It may be desirable to keep the media travel distance 'd' 220 constant for which the overall differential velocity 183 '$\pm\Delta_v$' is active to reduce firmware complexity. The media velocity is defined by the average speed of the first and second rollers 180*a*, 180*b* during skew correction. The distance 'd' 220 along with the average velocity 'v' define how long the differential velocity 183 is applied. The longer this time period, the more 'rotation' the media 106 undergoes. Accordingly, the media model 150 for determining differential velocity 183 may be changed to include or incorporate a linear relationship between a prior media model without speed correction and the average speed "v" such that a first alternative media model 150 is:

$$\Delta_v = \left(\left(\frac{-1 * S_{in} - b}{m}\right)/2\right) * \left(\frac{v}{v_{cal}}\right)$$

Where $v_{cal}$ is the average speed of the first and second rollers 180*a*, 180*b* used during the 'differential velocities' phase of skew correction, while generating the media model 150.

The media travel distance 'd' 220 is the distance of media travel over which the differential velocity 183 is maintained and affects how much 'rotation' the media 106 undergoes. The longer the distance, the more 'rotation' for a given differential velocity 183. While a fixed distance 'd' 220 may be desired, it is anticipated that the actual distance available in a particular hardware configuration of the media alignment system 100, 200 may change due to design changes or even firmware interactions with other threads of programs operating on the controller 120. The media model 150 equation may be adjusted to take into account or include that possibility such that a second alternative media model 150 is:

$$\Delta_v = \left(\left(\frac{-1 * S_{in} * \left(\frac{d_{cal}}{d}\right) - b}{m}\right)/2\right) * \left(\frac{v}{v_{cal}}\right)$$

Where $d_{cal}$ is an adjustment distance and distance 'd' 220 is the actual distance the skew correction occurs for the particular media alignment system 100, 200.

Another possible adjustment to the media model can be with respect to the pair of media sensor's 120*a*, 120*b* "squareness". For instance, due to mechanical variation, each media alignment system 100, 200 may have a unique 'native skew' or angular offset 232 (measured with respect to the plane of the media leading edge 108), referred to herein as "zero offset" or $S_{zero}$. For instance, $S_{zero}$ may be measured between a printhead, scan bar, or other target objective for the media 106 and a line (first dimension 104)

created by the two media edge detectors 122*a*, 122*b* as shown in FIG. 2. The new $S_{zero}$ adjusted media model is then:

$$\Delta_v = \left(\left(\frac{-1 * S'_{in} * \left(\frac{d_{cal}}{d}\right) - b}{m}\right)/2\right) * \left(\frac{v}{v_{cal}}\right)$$

Where $S'_{in}=S_{in}+S_{zero}$. The $S_{zero}$ 'native skew' value is a characteristic of a particular media alignment system 100, 200 and may be stored in non-volatile memory (NVM) in controller 120 after it is characterized or otherwise measured. The $S_{in}$ and $S_{out}$ captured during the "snapshot" of encoder positions are then compensated for by this $S_{zero}$ value to generate $S'_{in}$ and $S'_{out}$, which are used in the media model equations.

As noted, in some examples a predetermined amount of history of $S'_{in}$, and $S'_{out}$ pairs may be stored in a buffer in memory 130. In some examples, the buffer may be implemented as a circular buffer. For instance, a running sample of the last 30 $S'_{in}$ and $S'_{out}$ pairs may be statistically evaluated to determine if a characterization or maintenance service needs to be performed.

In some instances, a large $S'_{in}$ may cause a large '$\Delta_v$' which has the potential to damage the media 106 by way of inducing crinkles into it or even tearing the media 106 due to in-plane shear. In one example, the media alignment system 100, 200 may perform multiple passes of the media 106 through the system before further processing it in order to correct for a large $S'_{in}$. Thus, the skew correction module 190 may be executed by the controller 120 multiple times for the media 106 to limit the amount of skew correction per pass to prevent damage to the media 106. The instructions in the skew correction module 190 may thus determine the media type 107 and limit the differential velocity 183 in a single pass to allow for only a limited edge skew correction value. Then by using multiple passes of the media 106 through the pair of aligned media sensors 120*a*, 120*b* to correct over multiple passes a leading edge skew greater than the limited edge skew correction value.

Figure 5:
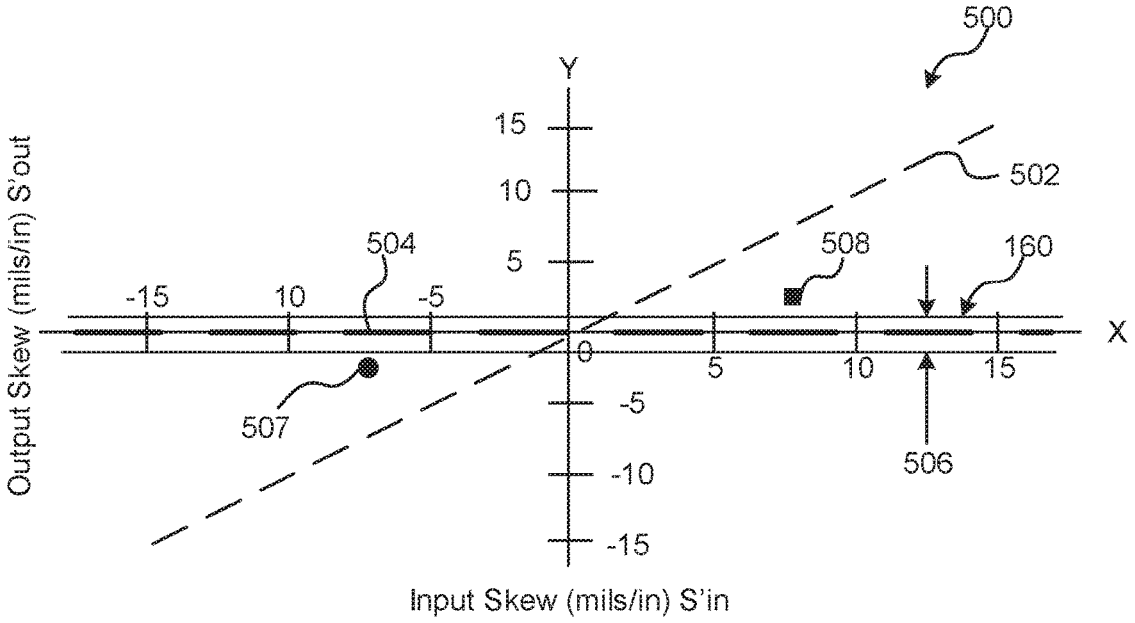
FIG. 5 is a result chart with example input skew "$S'_{in}$" on the X axis and example resultant output skew "$S'_{out}$" on the Y axis.

FIG. 5 is a result chart 500 with the example media response to input skew $S'_{in}$ in mils/in units on the X axis and the output skew $S'_{out}$ in mils/in units on the Y axis. First dashed line 502 has an 'm' value of 1 and a 'b' value of 0 and represents what would be expected if there were no skew correction or adjustment made. That is, the output skew would match the input skew. Second dashed line 504 is on the X axis and has an 'm' value of 0 and a 'b' value of '0' and represents a perfect correction or reduction of skew. However, in actual products, complete correction of skew may not always be possible and most values may lie between a desired operational window 160 which limits the output skew to a range within the skew tolerance width 506 of the operational window 160. In one example, the operational window 160 skew tolerance width 506 may be +/−1.5 mils per inch. Also, the operational window may include a trigger value for flagging when to service the media alignment system 100. For example, if more than 50% of the media pages fall outside of the skew tolerance width of +/−1.5 mils, then a service message or characterization request may be requested. Depending on a media alignment systems 100, 200 implementation, there may be one or more operational windows 160 in memory 120. The different operational windows 160 would be chosen based on the media type 107 and the expected results desired given a various operating modes of the media alignment system 100, 200, such as a high, medium, or draft selection of print modes. Some media types 107, such as clear Mylar sheets for overhead slides, may want a relaxed operating window 160 to limit the amount of shear force on the media which may cause visual distortions. Media types for photographs may want a narrowed operating window 160 to ensure accurate alignment of the printed photos for later cutting of the photos from the media.

Occasionally, there may be data pairs such as first data pair 507 and second data pair 508 which did not correct the output skew such that they fall outside the operational window 160. Based off the number of times such events occur or based off of statistics of past history results, action may be taken such as notifying the user of the media alignment system that service is required, scheduling a service call, performing a maintenance characterization or calibration, flagging an error, providing a warning message, or adjusting the various media models accordingly if a consistent error is being made. For instance, a calibration cycle can be performed for a printer by having a user load a paper tray with a set of sheets of the media types 107 that are having skew correction issues. The printer can run the set of sheets of media 106 through the media alignment system 100, 200 to create a set of induced skews 410 versus various different differential velocities 183 for each of the set of sheets, which may be of one or more media types 107. A media model 150 may then be updated based on the empirical results to create a new linear 'b' and 'm' model for the printer for each media type 107.

Figure 6:
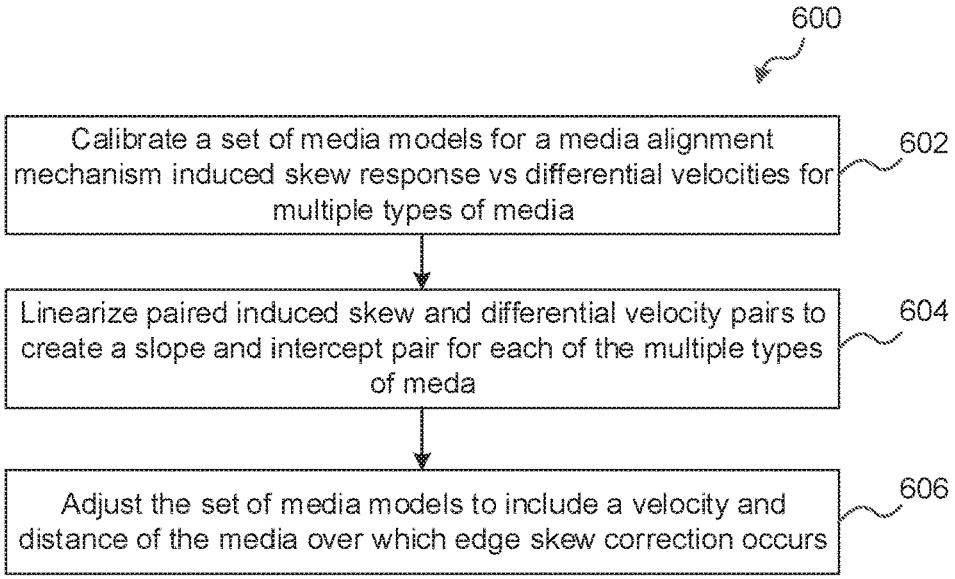
FIG. 6 is an example method for calibrating a set of media models.

FIG. 6 is an example method 600 for calibrating a set of media models 150. In block 602, a media alignment mechanism 110 has its induced skew response 410 to differential velocities 183 of a pair of rollers 180*a*, 180*b* characterized to create a set of paired induced skew and differential velocity values for multiple types 107 of media 106. In block 604, the paired induced skew and differential velocity value are linearized, such as by using linear regression, to create a slope 'm' and intercept 'b' value pairs or paired constants for each of the set of media models 150. The slope and intercept value pairs are used to correct skew of the media 106 in the media alignment mechanism 110. In block 606, the set of media models 150 are adjusted to include a velocity and distance of the media over which edge skew correction occurs in the media alignment mechanism 110.

Figure 7:
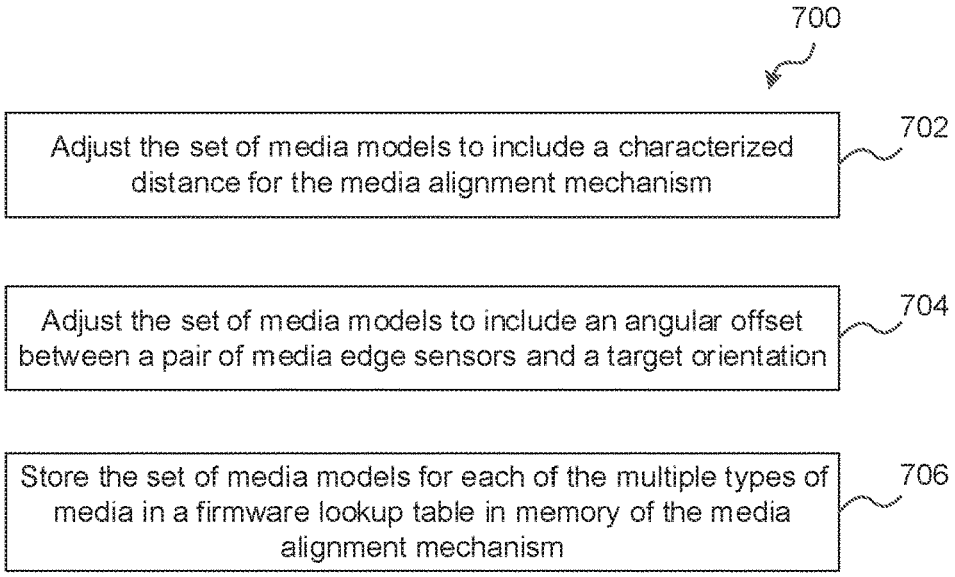
FIG. 7 is a set of additional blocks that may be performed with the example method of FIG. 6 to calibrate a set of media models.

FIG. 7 is a set of additional blocks 700 that may be performed with the example method 600 of FIG. 6 to calibrate a set of media models 160. For instance, in block 702, the set of media models 150 may be adjusted to include a characterized distance '$d_{cal}$' for the media alignment mechanism 110. In block 704 the set of media models 150 may be adjusted to include an angular offset between a pair of media edge sensors 172*a*, 172*b* and a target orientation. The target orientation is some examples may be a printhead for a printer and in other examples may be input into another media manipulation device such as a scanner, sorter, folder, binder, laminator, coater, and the like. In block 706, the set of media models 150 for each of the multiple types of media 107 are stored in a firmware lookup table in memory 130 of controller 120 in the media alignment mechanism 110.

Figure 8:
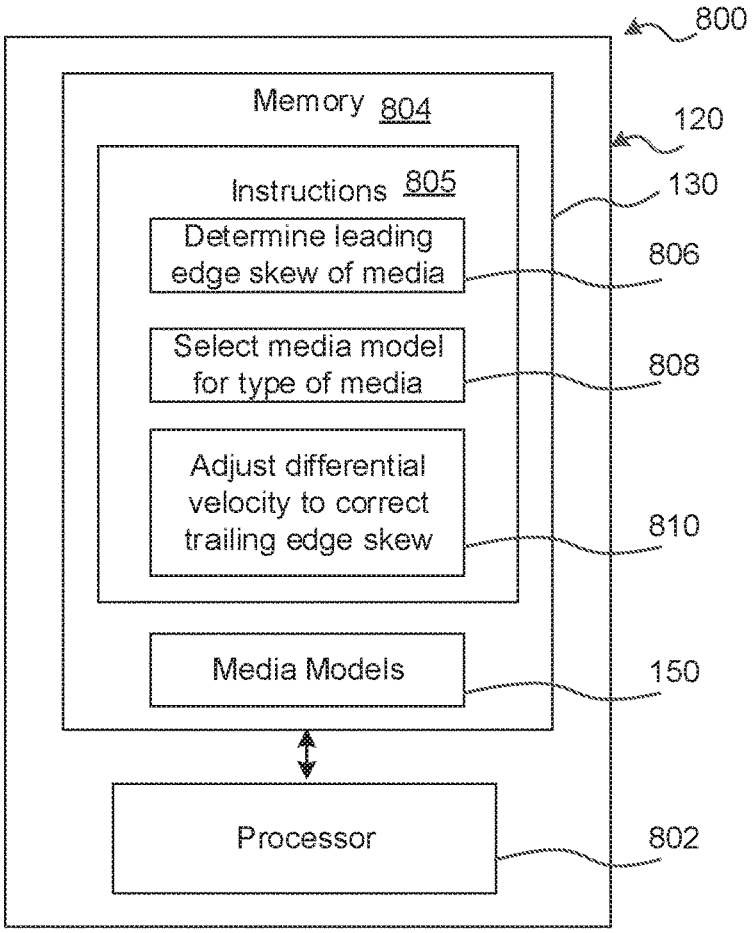
FIG. 8 is an example implementation of a controller having a computer readable medium (CRM) with instructions to perform media alignment.

FIG. 8 is an example implementation 800 of an example controller 120, which may include tangible and non-transitory computer readable medium (CRM) 804 coupled to a processor 802. CRM 804 may be integrated into the same device as controller 120 or it may be separate but accessibly coupled to controller 120. In one example, the instructions may be part of an installation package that when installed may be executed by the controller 120 to implement the media alignment system 100. In this example, the CRM 804 may be a portable medium such as a CD, DVD, or flash drive or a memory maintained by a server from which the installation package may be downloaded and installed.

In another example, the instructions may be part of an application or applications already installed. In this example, CRM 804 may include integrated memory such as hard drives, solid state drives, flash drives, dynamic or static random access memory, programmable read only memory, and the like. Accordingly, the computer readable medium 804 may include processor cache of one or more levels, dynamic random access memory (DRAM), non-volatile memory such as flash, EEPROM, PROM, and the like as well as magnetic memory, optical memory, ionic memory, phase change memory, and other equivalent types of long term storage including battery backed static random access memory (SRAM). CRM 804 may include the memory 130.

The processor 802 may include one or more cores of general purpose central processing units (CPU) or one or more cores of special purpose algorithmic processing units, such as digital signal processors, I/O controllers, video controllers, ladder controllers, and the like. The processor 802 is coupled to the CRM 804 and is able to read and write instructions 805, such as skew correction module 190 (FIG. 1), and data such as media models 150, operational windows 160 (FIG. 1), and the various data pairs derived from the pair of media edge sensors 172*a*, 172*b*.

The instructions 805 for skew correction module 190 may include determining the leading edge skew 174 of a media 106 in block 106. In block 808, other instructions may cause the processor to select a respective media model 150 from the memory 120 based off a media type detected or determined by the media alignment system 100, 200. Each of the media models 150 includes a paired slope "m' and an intercept 'b'. In block 810, based on the slope 'm' and intercept 'b' for the respective media model, the instructions 805 adjust a differential velocity 183 of a pair of aligned media feed rollers 180*a*, 180*b* in a media feed mechanism 110 to correct both the future 'native skew' and future paired leading 174 and trailing 176 edge skew values in the media 160 to within a desired operational window 160.

Figure 9:
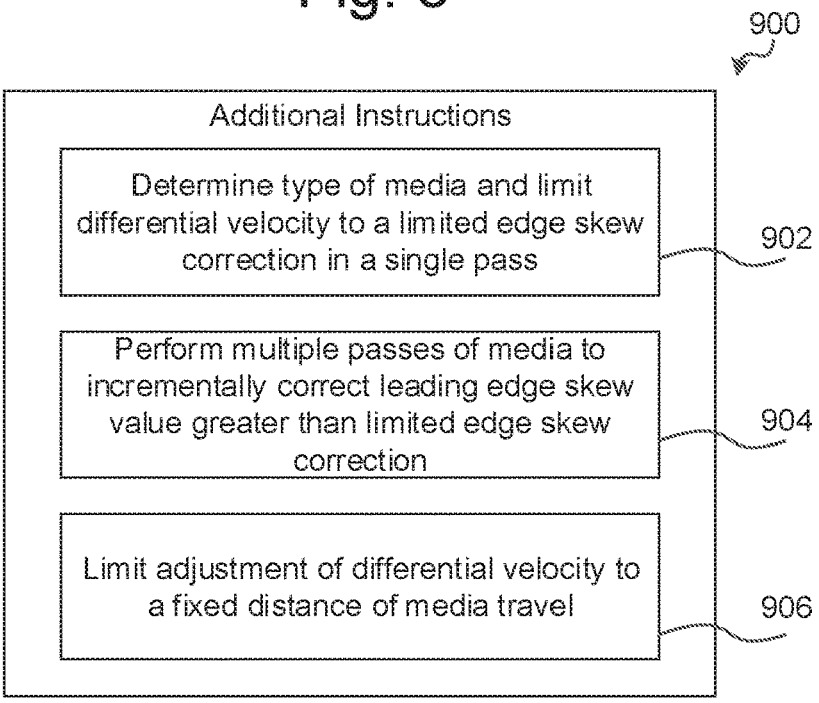
FIG. 9 is an example set of additional instructions for the CRM of FIG. 8 that may be used to improve aligning a media.

FIG. 9 is a set of additional example instructions 900 for CRM 804 that may be used to improve the updating of the media model 150. In block 902, the media type 107 and a limit differential velocity may be determined to provide limited edge skew correction within a single pass based on a determined media type. In block 904, the additional instructions 900 may allow for multiple passes of the media 106 to be performed to incrementally correct a leading edge skew value 174 that is greater than the limited edge skew correction. In block 906, the instructions may limit adjustment of differential velocity 183 to a fixed distance 'd' 220 of media travel. In some examples, the fixed distance 'd' 220 may have some variability depending on manufacturing tolerances or other, and a measured or characterized fixed distance value is incorporated as a constant in the respective media model 150.

The media alignment system and methods that have been described allow for a versatile skew correction technique that handles multiple media types and applied media marking coverage conditions to yield uniform performance. Acoustic noise reduction due to the new technique is superior to conventional stopped roller de-skew solutions since it is a continuous motion system. The same continuous motion allows for an increased pages per minute speed advantage over conventional approaches.

While the claimed subject matter has been particularly shown and described with reference to the foregoing examples, those skilled in the art will understand that many variations may be made therein without departing from the spirit and scope of subject matter in the following claims. This description should be understood to include all novel and non-obvious combinations of elements described herein, and claims may be presented in this or a later application to any novel and non-obvious combination of these elements. The foregoing examples are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A non-transitory computer readable medium to correct skew for a media comprising instructions that when executed by a processor cause the processor to:

determine a leading edge skew value for the media with a pair of media edge sensors;

receiving, at a controller, an input signal to indicate a media type;

select a respective media model from a memory for the media type based on the input signal, the respective media model including a paired slope and an intercept;

based on the paired slope and intercept for the respective media model, adjust a differential velocity of a pair of aligned media feed rollers in a media feed mechanism to correct a trailing edge skew for the media to within a desired operational window;

limit the differential velocity based on the media type to a limited edge skew correction value in each pass; and perform multiple passes of the media through the pair of aligned media feed rollers to incrementally correct the leading edge skew value if greater than the limited edge skew correction value.

2. The computer readable medium of claim 1 wherein the instructions to adjust the differential velocity limit over a distance of media travel, wherein the trailing edge skew is corrected after the media travels the distance.

3. The computer readable medium of claim 2 wherein the distance is to be measured and incorporated into the respective media model.

4. A system to correct skew for a media, comprising:

a media guide mechanism having a first roller and a second roller aligned in a first direction orthogonal to a second direction of advancement of the media having a media type;

a controller to operate independently the first and second rollers at differential velocities;

a memory coupled to the controller containing a set of media models;

a pair of media edge sensors coupled to the controller and aligned in the first direction to measure a leading edge skew and a trailing edge skew;

a skew correction module in the memory executable by the controller to adjust the differential velocities of the first and second rollers based on a respective media model for the media type and the leading edge skew to correct the trailing edge skew for the media to within a desired operational window; and a printhead substantially aligned in the first direction with an angular offset from a line extending between the pair of media edge sensors, and wherein the respective media model adjusts for the angular offset for the media type.

5. The system of claim 4, wherein the skew correction module is executable as a high priority process in the controller.

6. The system of claim 4, wherein the skew correction module is triggerable to be executed after both of the pair of media edge sensors detect a leading edge of the media.

7. The system of claim 4, wherein the skew correction module is executable by the controller multiple times for the media to limit an amount of skew correction per pass to prevent damage to the media.

8. A method of calibrating a set of media models for media skew correction, comprising:

creating a set of paired induced skew and differential velocity values for multiple types of media based on a media alignment mechanism induced skew caused by differential velocities of a pair of roller feeds;

linearizing the set of paired induced skew and differential velocity values to create a slope and intercept value pair for the set of media models for each of the multiple types of media, wherein the slope and intercept value pair are used to correct skew of the media; and adjusting the set of media models to include a velocity and distance of the media over which edge skew correction occurs.

9. The method of claim 8, wherein the distance is variable, and the media model is adjusted to reflect a characterized distance for a media alignment mechanism.

10. The method of claim 8, further comprising adjusting the set of media models to include an angular offset between a pair of media edge sensors and a target orientation.

11. The method of claim 10, wherein the target orientation is a line of a printhead.

12. The method of claim 8 further comprising storing the set of media models for each of the multiple types of media in a firmware lookup table in a memory of a media alignment mechanism.

* * * * *